United States Patent [19]

Reifert

[11] 4,090,604

[45] May 23, 1978

[54] COVER CONSTRUCTION

[75] Inventor: Charles W. Reifert, Muscatine, Iowa

[73] Assignee: Grain Processing Corporation, Muscatine, Iowa

[21] Appl. No.: 722,539

[22] Filed: Sep. 13, 1976

[51] Int. Cl.[2] ..... B65G 15/60; B65G 33/00

[52] U.S. Cl. ..... 198/861; 198/657; 220/256

[58] Field of Search ..... 198/657, 860, 861; 119/52 AF, 56 R, 63; 52/127; 259/125, 116, 115; 220/256

[56] References Cited

U.S. PATENT DOCUMENTS

| | | | |
|---|---|---|---|
| 2,656,036 | 10/1953 | Whitney | 198/861 |
| 3,878,936 | 4/1975 | Niggemyer | 198/861 |

*Primary Examiner*—Evon C. Blunk
*Assistant Examiner*—Joseph E. Valenza
*Attorney, Agent, or Firm*—Neuman, Williams, Anderson & Olson

[57] ABSTRACT

A cover for material handling equipment including a lower and upper cover plate disposed in overlapping relationship and having means thereon adapted to engage a flange element on the material handling equipment so as to form a seal.

3 Claims, 3 Drawing Figures

FIG. 1
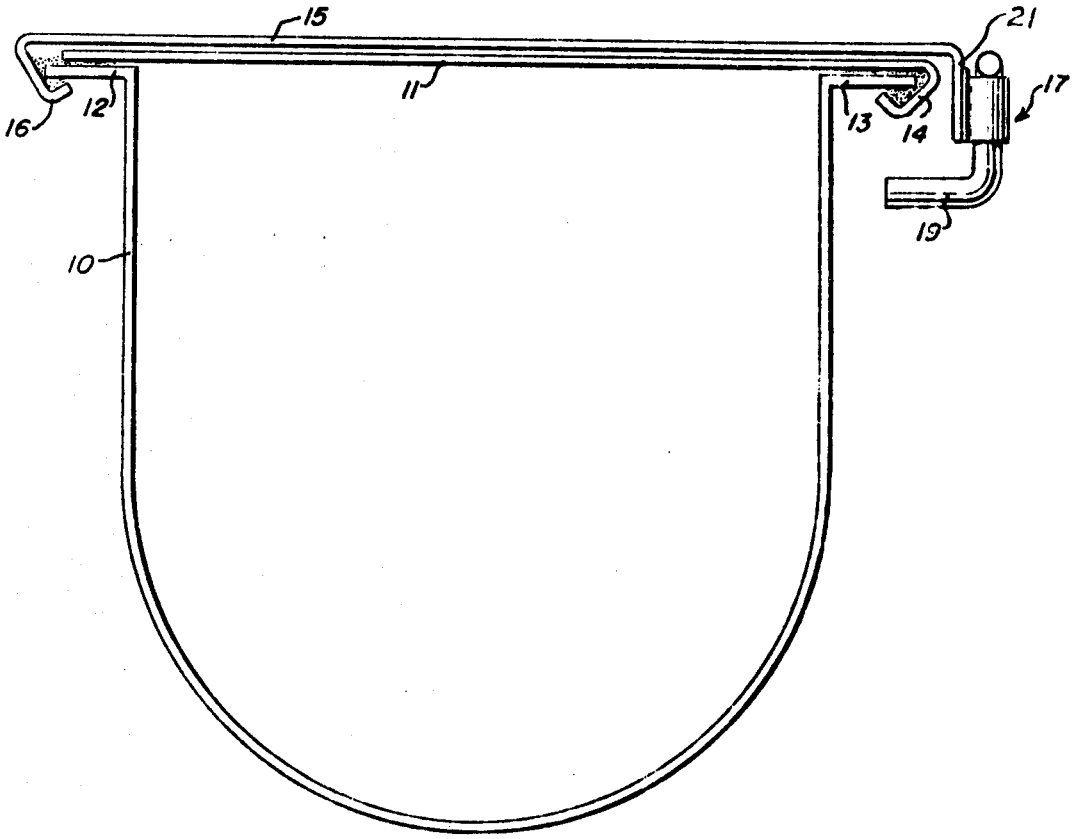
FIG. 2
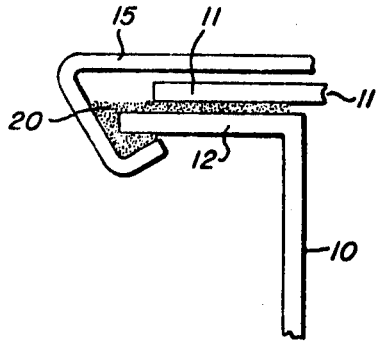
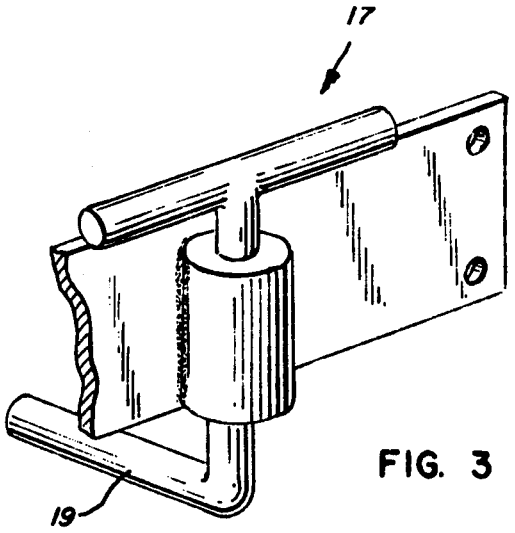
FIG. 3

COVER CONSTRUCTION

This invention relates to material handling and is concerned particularly with a novel cover construction for material handling equipment.

The handling of various materials by means of in-line continuous mixers and conveyor systems of various types is, of course, well known. In many instances it is desired or necessary that the material handling equipment be provided with a cover to retain the material being handled within the equipment or for other reasons. Thus, for example, a serious problem encountered with covered conveying systems is that very often the conveyor cover fails to prevent spill-over of the material being conveyed and when a dusty material is being conveyed the cover often fails to prevent leakage of dust therefrom. Such occurrences entail additional clean-up work. Furthermore, escape of dust may create a health hazard for workers and others exposed thereto.

It is therefore a principal object of this invention to provide a cover for material handling equipment which is of such construction as to effectively prevent spill-over of material being handled and escape of dust particles from the equipment.

Other objects and advantages of this invention will be apparent from the following description considered in light of the accompanying drawings in which:

FIG. 1 is a fragmentary transverse view of a conveyor having a cover constructed in accordance with the invention.

FIG. 2 is a fragmentary view of one side of the conveyor cover showing a seal formed by build-up of conveyed product.

FIG. 3 is a perspective view of one optional locking arrangement for the conveyor cover.

In the drawings, FIG. 10 refers to a portion of the housing of a conveyor which can be of any known type, such as a spiral, worm or screw conveyor. The invention is applicable to material handling equipment other than conveyors and the cover is generally useful with material handling equipment having flange members to which the cover can be cooperatively engaged.

The illustrative conveyor shown in the drawing has a U-shaped trough, but the shape, size and material of construction of the conveyor can be varied as is known. The cover of this invention comprises a lower cover plate 11 of sufficient size to extend from flange 12 to flange 13 located on opposite sides of the conveyor trough. The cover plate 11 is provided at its one end with a downwardly extending hook section 14, which is adapted to extend under and engage a flange on the conveyor housing. As shown in the drawing, the hook section 14 is V-shaped but it can also be in other shapes such as J-shaped or L-shaped. A second upper cover plate 15 fits over the lower cover plate 11 and extends the entire transverse dimension of the conveyor in overlapping relationship. The upper cover plate is also provided at one side with a downwardly extending hook section 16 adapted to extend under and engage a flange on the conveyor housing. The distal side of the upper cover plate 15 is bent at a 90° angle to form a flange portion 21. This flange portion 21 ensures that the cover remains in position regardless of vibration or side force of any kind.

As shown in the drawing, locking means 17, which as shown is a T-bar lock, is attached to flange portion 21.

Other equivalent locking arrangements on one end of the upper cover plate can be similarly employed, if desired. Locking means 17 is an optional feature and is employed in applications where the cover is subjected to forces such as high winds which tend to lift off the cover.

To place the cover on a conveyor or other material handling apparatus, the lower plate 11 is first laid in place over the conveyor trough with its hook end 14 disposed under one of the flanges (12) on the conveyor housing. Next, the upper cover plate is placed over the lower plate with its hook end 16 disposed under the opposite flange (13) of the conveyor housing. If necessary or desired to lock the conveyor cover in place, the T-bar lock is rotated so that its lower lip 19 extends under hook 14 of the lower cover plate in a transverse direction to the conveyor housing. With the T-bar lock thus positioned, the conveyor is ready for use to convey materials. In use, the material 20 being conveyed tends to form a seal between the flanges on the conveyor housing and the lower cover plate (FIG. 2), further preventing spill-over and escape of dust. To remove the cover, the T-bar lock is raised and rotated so that the lower lip 19 will clear flange 12 and hook end 14. The T-bar lock may be designed so that it cannot be rotated without first raising it enough to clear the cover. This design feature causes it to self-lock in the open and closed positions.

From the foregoing description it will be seen that this invention provides a very simple and inexpensive cover for conveying systems. The cover is self-sealing due to conveyed product build-up, yet it requires no complicated system of bolts or clamps. The cover plates are held in place by virtue of the upper plate 15 exerting considerable force through leverage on the lower plate 11. The leverage created by the weight of the top cover plate on the lower plate ensures that the cover does not lift off, even under operating conditions in which a material is forced against the cover, which may occur when the conveyor is plugged or operated completely full. The cover construction does not involve use of gaskets, critical fittings or measurements and is easily constructed to fit conveyors of varying dimensions.

Those modifications and equivalents which fall within the spirit of the invention are to be considered a part thereof.

What is claimed is:

1. A cover for material handling equipment having flange elements thereon, said cover means including a lower cover plate of sufficient size to extend at least to said flange elements and having on one side only downwardly and inwardly projecting means for positioning under a flange element on material handling equipment, an upper cover plate overlapping at least a portion of said lower cover plate in superimposed position and having on one side thereof a downwardly and inwardly projecting means for positioning under a flange element on material handling equipment and on the distal side thereof a downwardly extending flange portion.

2. A cover for material handling equipment in accordance with claim 1 including means attached to said upper cover plate for locking said plate to the material handling equipment.

3. A cover in accordance with claim 2 wherein said locking means is a rotatable locking member.

* * * * *